US006782971B2

(12) United States Patent
Dutton et al.

(10) Patent No.: US 6,782,971 B2
(45) Date of Patent: Aug. 31, 2004

(54) SERVICEABLE ACOUSTIC INTERIORS

(75) Inventors: Steven Dutton, Austin, TX (US); John Phillips, Austin, TX (US)

(73) Assignee: ETS-Lindgren, L.P., Cedar Park, TX (US)

( * ) Notice: Subject to any disclaimer, the term of this patent is extended or adjusted under 35 U.S.C. 154(b) by 8 days.

(21) Appl. No.: 10/226,439

(22) Filed: Aug. 23, 2002

(65) Prior Publication Data

US 2003/0155176 A1 Aug. 21, 2003

Related U.S. Application Data

(60) Provisional application No. 60/358,033, filed on Feb. 19, 2002.

(51) Int. Cl.[7] ..... E04B 1/82; E04B 9/00

(52) U.S. Cl. ..... 181/284; 181/179; 181/290; 52/144

(58) Field of Search ..... 181/211, 287, 181/290, 295, 296, 179, 210, 284; 52/144, 145, 71, 239, 36.1; 160/135, 236; 312/351, 351.1, 351.11

(56) References Cited

U.S. PATENT DOCUMENTS

| | | | | | |
|---|---|---|---|---|---|
| 1,910,160 | A | * | 5/1933 | Gorman | 52/460 |
| 1,966,041 | A | * | 7/1934 | Nelson | 52/389 |
| 1,984,028 | A | * | 12/1934 | Macleod | 52/779 |
| 2,308,869 | A | * | 1/1943 | Eckardt | 181/291 |
| 2,317,634 | A | * | 4/1943 | Olsen | 52/242 |
| 2,334,484 | A | * | 11/1943 | Dunbar | 362/150 |
| 2,667,667 | A | * | 2/1954 | Jacobson | 52/506.06 |
| 3,136,397 | A | * | 6/1964 | Eckel | 52/280 |
| 3,153,304 | A | * | 10/1964 | Evangelista | 52/144 |
| 3,313,076 | A | * | 4/1967 | MacDonald | 52/781 |
| 3,350,831 | A | * | 11/1967 | Miller | 52/506.06 |
| 3,782,495 | A | * | 1/1974 | Nassof | 181/284 |
| 4,324,072 | A | * | 4/1982 | Sterner, Jr. | 49/129 |
| 4,702,046 | A | * | 10/1987 | Haugen et al. | 181/286 |
| 4,989,688 | A | * | 2/1991 | Nelson | 181/287 |
| 5,641,950 | A | * | 6/1997 | Kotter | 181/285 |
| 5,896,710 | A | * | 4/1999 | Hoyle | 52/144 |

FOREIGN PATENT DOCUMENTS

| | | | | | |
|---|---|---|---|---|---|
| DE | 3237062 | A1 | * | 4/1984 | G10K/11/16 |
| DE | 4319073 | A1 | * | 12/1994 | E04F/13/08 |
| FR | 2690000 | A1 | * | 10/1993 | G10K/11/16 |
| GB | 2260184 | A | * | 4/1993 | E04B/1/84 |
| JP | 05165481 | A | * | 7/1993 | G10K/11/16 |
| JP | 06149265 | A | * | 5/1994 | G10K/11/16 |
| JP | 06173363 | A | * | 6/1994 | E04B/1/99 |

* cited by examiner

*Primary Examiner*—David Martin
*Assistant Examiner*—Eduardo Colon Santana
(74) *Attorney, Agent, or Firm*—Patrick Stellitano

(57) ABSTRACT

The present invention provides methods and apparatus for constructing an acoustic absorbing structure, such as a wall or enclosure, with removable and serviceable acoustic absorbing panels.

19 Claims, 9 Drawing Sheets

SERVICEABLE ACOUSTIC INTERIORS

This application claims the benefit of Provisional Application No. 60/358,033 filed Feb. 19, 2002.

TECHNICAL FIELD OF THE INVENTION

The present invention relates to the field of acoustic absorbing structures.

BACKGROUND OF THE INVENTION

Acoustic enclosures are used to insulate sound generated inside the enclosure from the exterior environment, to insulate the interior of the enclosure from sound generated in the exterior environment, and to reduce reverberation of sound within the enclosure.

For example, many high schools and music schools provide sound isolation modules for music practice, enabling a plurality of music students, each one in a separate module, to simultaneously play his or her instrument without acoustical interference from music generated in another enclosure or from sound generated in an environment exterior to the sound isolation module. In an industrial setting, machinery often generates large volumes of sound that interfere with human productivity within offices that need to be located at or near the sight of the machinery. In this case, an acoustic enclosure is often deemed essential, or at least highly desirable, to protect the office environment from the machinery noise. A radio broadcast booth is another familiar example where acoustic enclosures are instrumental in shielding from unwanted penetration of acoustic energy and reverberations. In some cases a wall or surface, less than an enclosure, provides acoustic absorption. For example portions of hallway walls may provide acoustic absorption to reduce acoustic reverberation.

An acoustic structure typically is formed of a plurality of panels, each panel comprising one or more acoustic absorbing materials enclosed by steel or other rigid structure. An acoustic enclosure is provided with an access door, and a window may also be included to allow one to see inside or outside the enclosure. The acoustic absorbing panels are subject to normal wear, and are often subject to harsh or stressful treatment. For example, furniture may impact and dent them or they may be subject to malicious abuse. Liquids that degrade acoustic performance or degrade the acoustic material may be absorbed by or splashed into the acoustic absorbing material within the panel.

For at least these reasons it is desirable to remove and replace or maintain one or more individual absorbing panels without deconstruction of the structure. Further, it is desirable that repair and maintenance be performable quickly, easily, and with a minimum of technical skill and tools.

Thus, there is a need for an invention that provides an acoustic absorbing structure with easily serviceable acoustic absorbing panels.

SUMMARY OF THE INVENTION

The present invention provides methods and apparatus for constructing an acoustic absorbing structure, such as a wall or enclosure, with removable, serviceable and replaceable acoustic absorbing panels. According to the present invention, retention mechanisms are provided for inserting and retaining acoustic absorbing panels against one or more walls without the use of fastening devices such as rivets, screws or adhesive. According to the present invention, a panel may be installed by inserting the top of the panel into an upper channel, pushing the panel toward the wall, and then inserting the bottom of the panel into a lower channel. A panel may be removed by lifting the panel up out of the lower channel, pulling the panel away from the wall, and then lowering the panel out of the upper channel. The invention enables installation of an acoustic absorbing structure to a wall or room that is not originally designed to exhibit any particular acoustic performance, or where the acoustic performance is not adequate or should be altered. The invention also enables simple and quick installation and removal of any one or more acoustic absorbing panels for repair, maintenance or replacement, without the need for fastening or unfastening a panel to a structure.

The foregoing has outlined rather broadly the features and technical advantages of the present invention in order that the detailed description of the invention that follows may be better understood. Additional features and advantages of the invention will be described hereinafter. It should be appreciated by those skilled in the art that the disclosure provided herein may be readily utilized as a basis for modifying or designing other structures for carrying out the same purposes of the present invention. Persons of skill in the art will realize that such equivalent constructions do not depart from the spirit and scope of the invention as set forth in the appended claims, and that not all objects attainable by the present invention need be attained in each and every embodiment that falls within the scope of the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
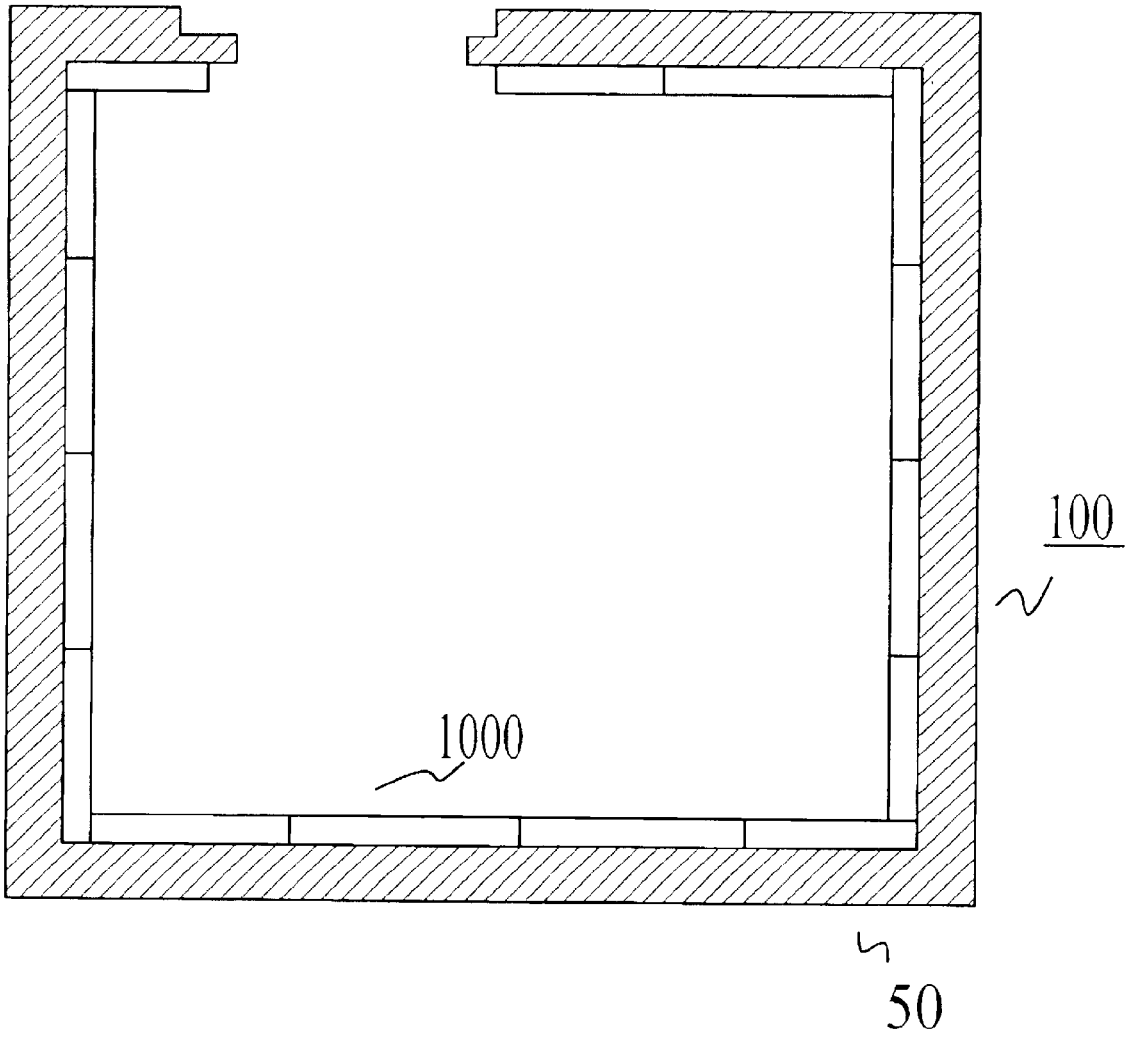
FIG. 1 is a plan view of an acoustic enclosure.
Figure 2:
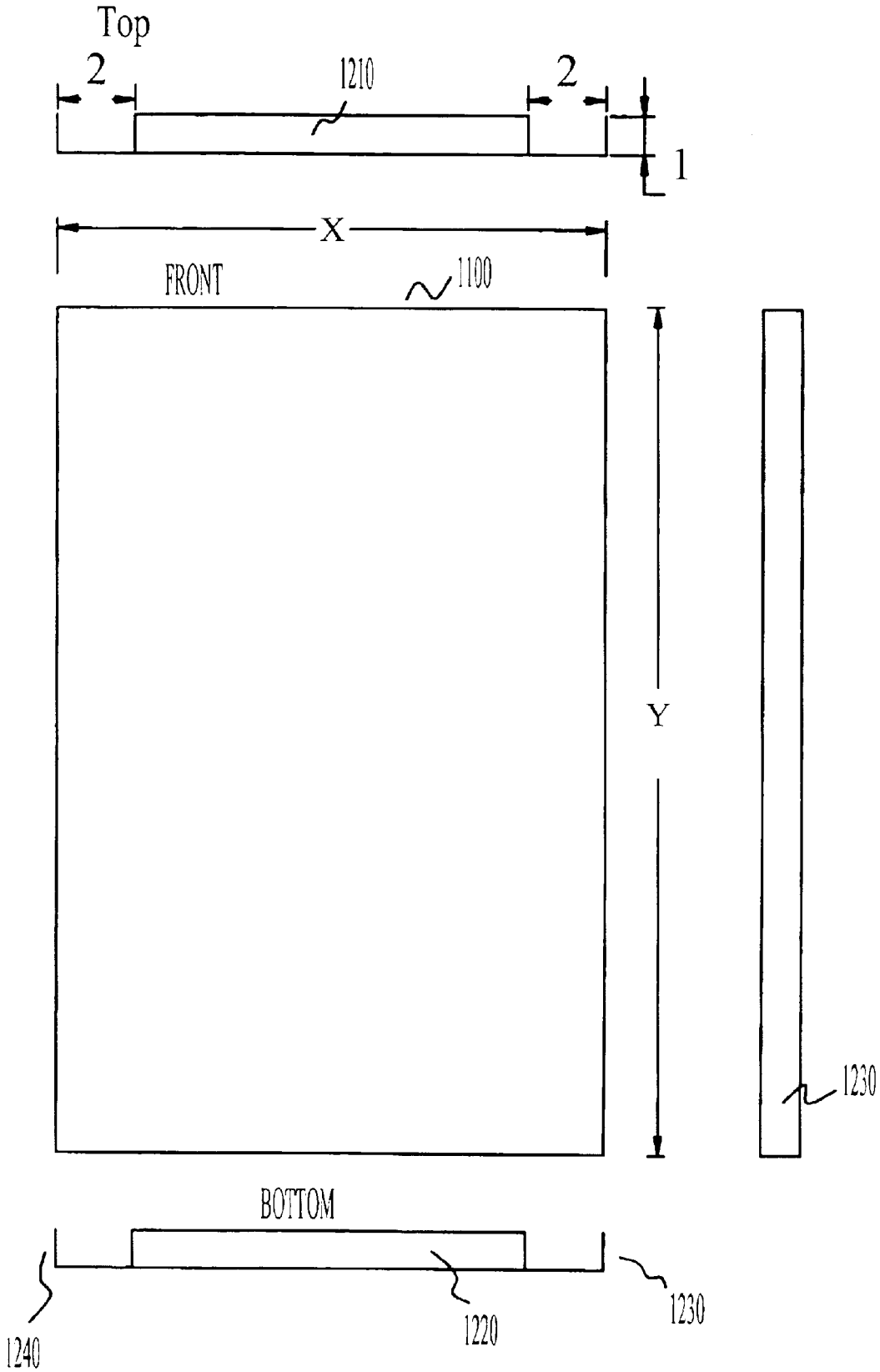
FIG. 2 is a view of a perforated steel sheet that is bent at its edges.

FIG. 1 is a plan view of an acoustic enclosure 100. Walls 50 provide structural integrity for enclosure 100. Interior to walls 50 are acoustic absorbing panels 1000 constructed according to the present invention to be easily removable for repair, maintenance, or replacement. As shown in FIG. 2, a panel 1000 preferably comprises a sheet of perforated steel 1100 that is bent to form edges at the top 1210, bottom 1220, and sides 1230 and 1240. The width X and height Y of sheet 1100 is determined by the size of acoustic enclosure 100. The thickness of sheet 1100 is preferably 22 gauge. The numerical dimensions shown in the drawings are nominal and in units of inches.

Figure 3:
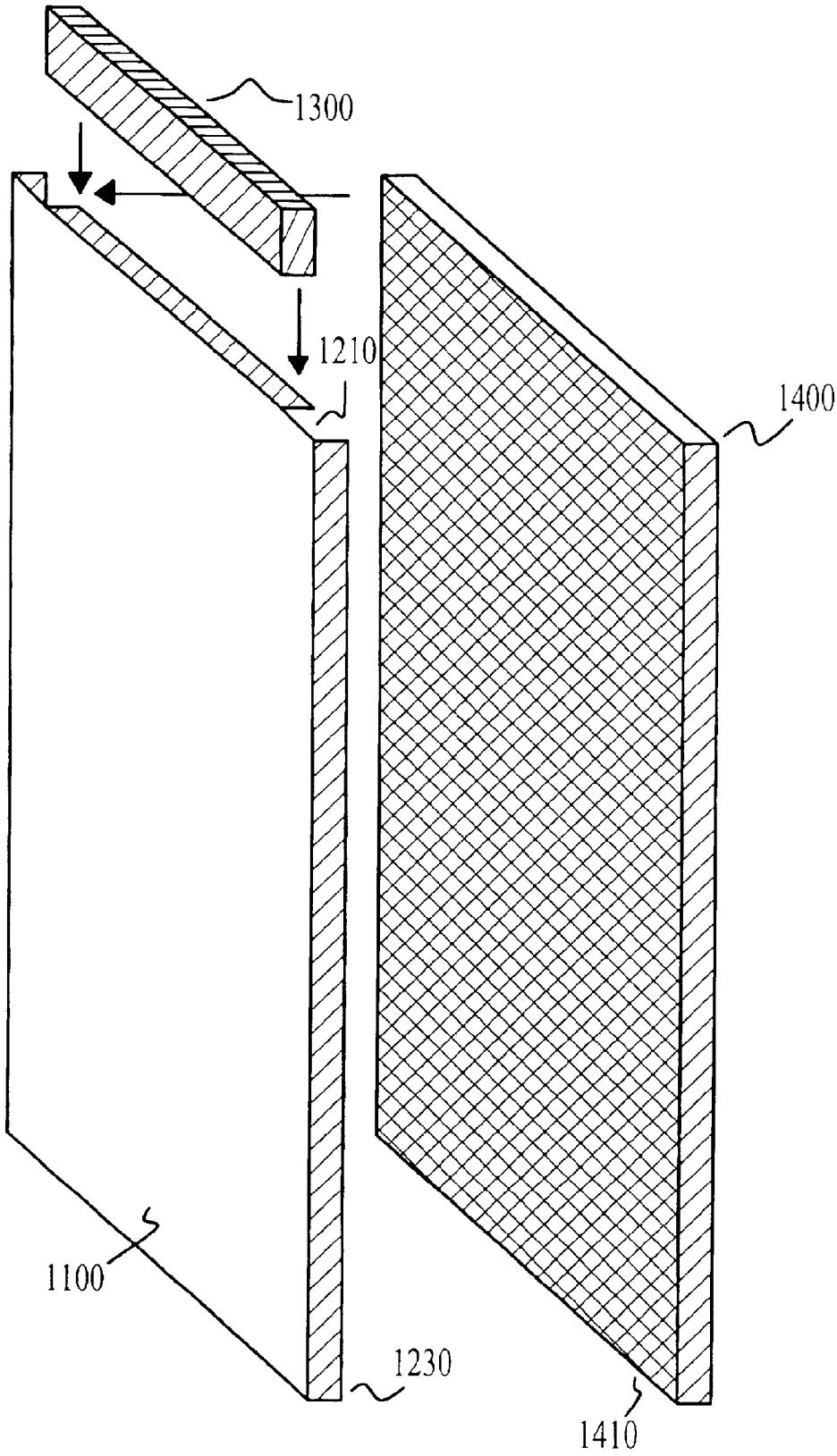
FIG. 3 shows a perspective view of a serviceable absorbing panel.

FIG. 3 shows a perspective view of panel 1000. Attached to top edge 1210 of sheet 1100 is an elastic mechanism 1300. Elastic mechanism 1300 is a suitable material or apparatus, such as "foam rubber" or a spring mechanism, that compresses when under pressure and exhibits a restoring force to return to an uncompressed state when pressure is removed. Elastic mechanism 1300 is adhered to top edge 1210 by a suitable adhesive. Inserted between the edges 1210, 1220, 1230, and 1240, and against the surface of sheet 1100 is an acoustic absorbing structure 1400. Thus, sheet 1100 with edges 1210, 1220, 1230, and 1240 forms a pan-like structure for receiving acoustic absorbing structure 1400.

Acoustic absorbing structure 1400 comprises one or more acoustic absorbing materials for absorbing acoustic energy, and may further comprise a thin layer of a liquid-resistant coating 1410 to resist damage by, and absorption of, liquids that could be splashed onto panel 1000 or moisture from humid air.

Figure 4:
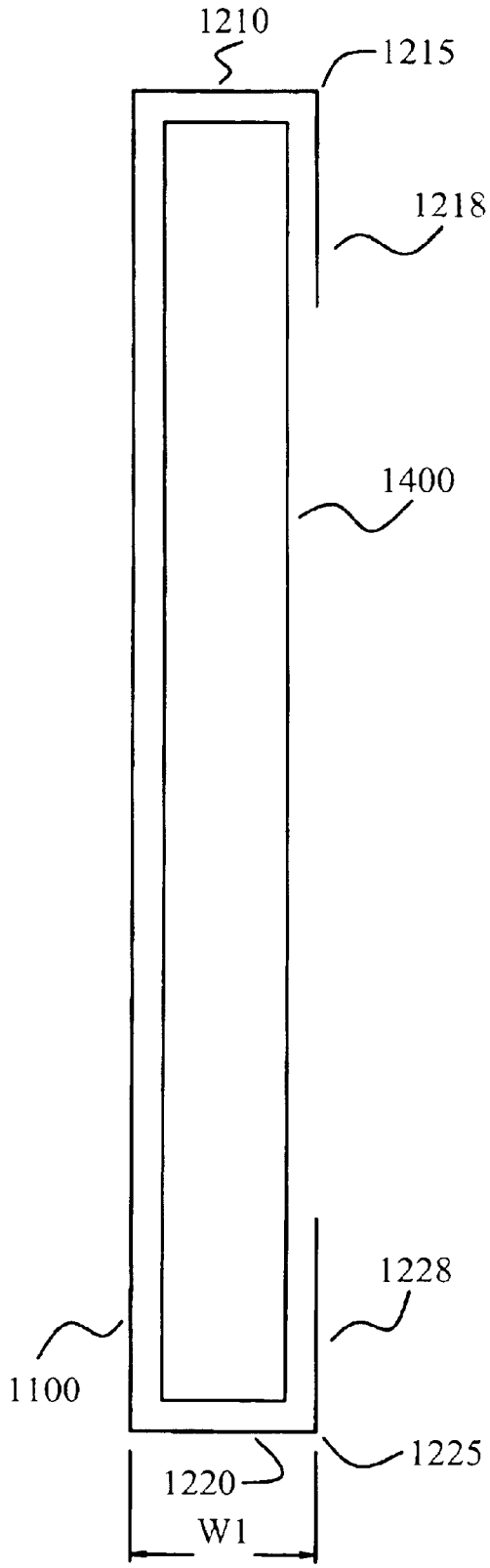
FIG. 4 shows a cross-sectional view of a serviceable acoustic absorbing panel.

Acoustic absorbing structure 1400 is preferably removably retained within proximity of the interior surface of sheet 1100. For this, a pan-like structure may be formed of sheet 1100 by additional bends formed in sheet 1100. A cross-sectional view of sheet 1100 is shown in FIG. 4, showing that a bend 1215 is formed in top edge 1210 to form a top-rear retaining edge 1218 and a bend 1225 is formed in bottom edge 1220 to form a bottom-rear retaining edge 1228. Note that bends 1215 and 1225 are at a point to form an exterior width, w1, sufficiently wide to accommodate acoustic absorbing structure 1400. Similarly, additional bends may be formed in edges 1230 and 1240 to form side-rear retaining edges for further retaining support of absorbing structure 1400 within the pan-like structure of sheet 1100.

Figure 5:
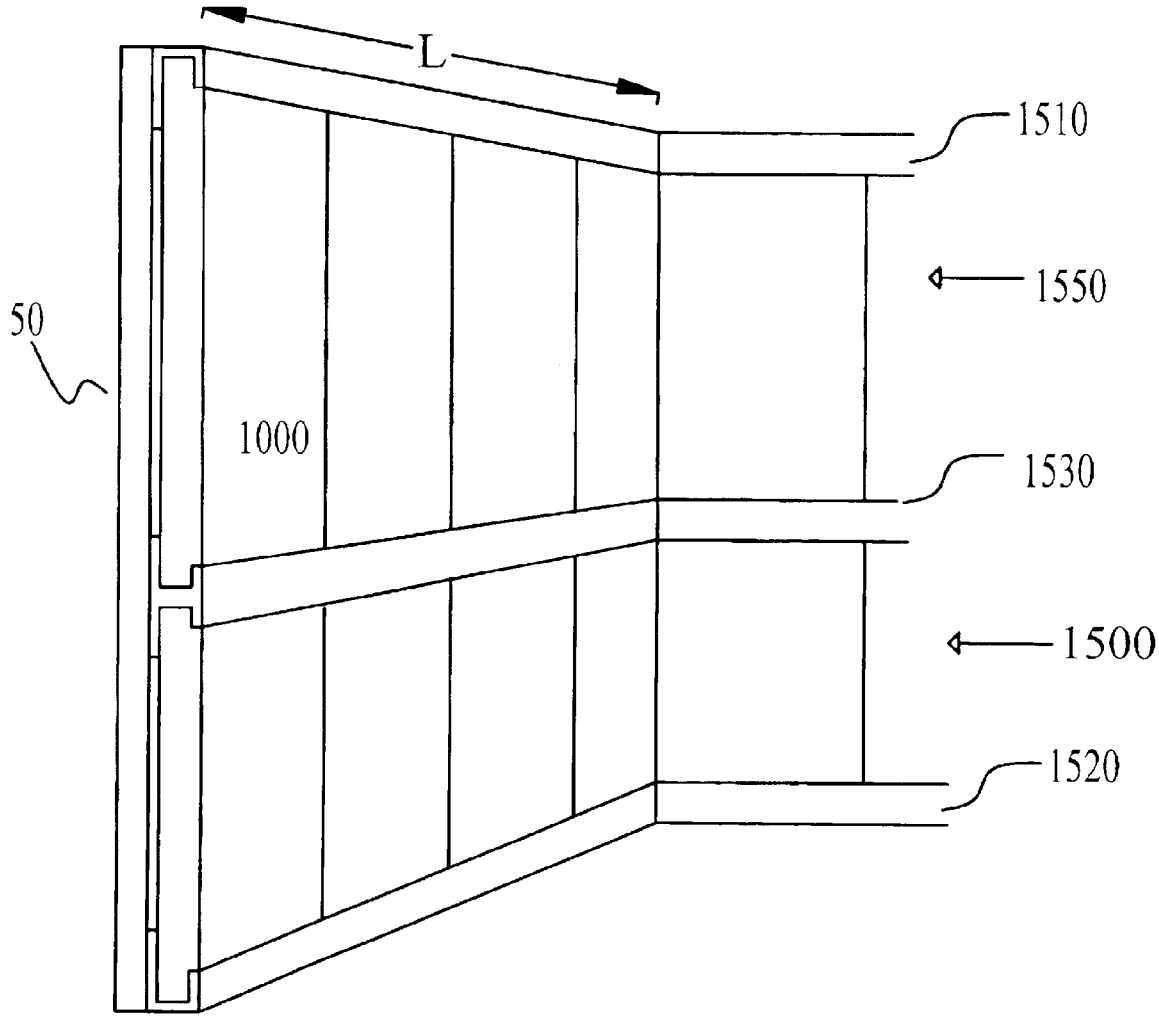
FIG. 5 shows an upper and lower row of removable, serviceable acoustic panels.

Each panel 1000, constructed as described above, covers a portion of a wall 50 of acoustic enclosure 100 and may easily be installed and removed as will be described herein. An acoustic enclosure 100 or an acoustically absorptive wall 50 is preferably constructed with a lower row 1500 of acoustic panels 1000 and an upper row 1550 of acoustic panels 1000, as shown in FIG. 5. An upper row 1550 and a lower row 1500 of panels 1000 are retained in place with retaining channels comprised of a ceiling rail 1510, a floor rail 1520, and a middle rail 1530. The dimensions of the enclosure or wall area to be covered by acoustic panels may determine the length L of ceiling rail 1510, floor rail 1520, and middle rail 1530. However, a rail for retaining a panel can be constructed, given the disclosure herein, that extends in dimension to less than the width of a panel.

Figure 6:
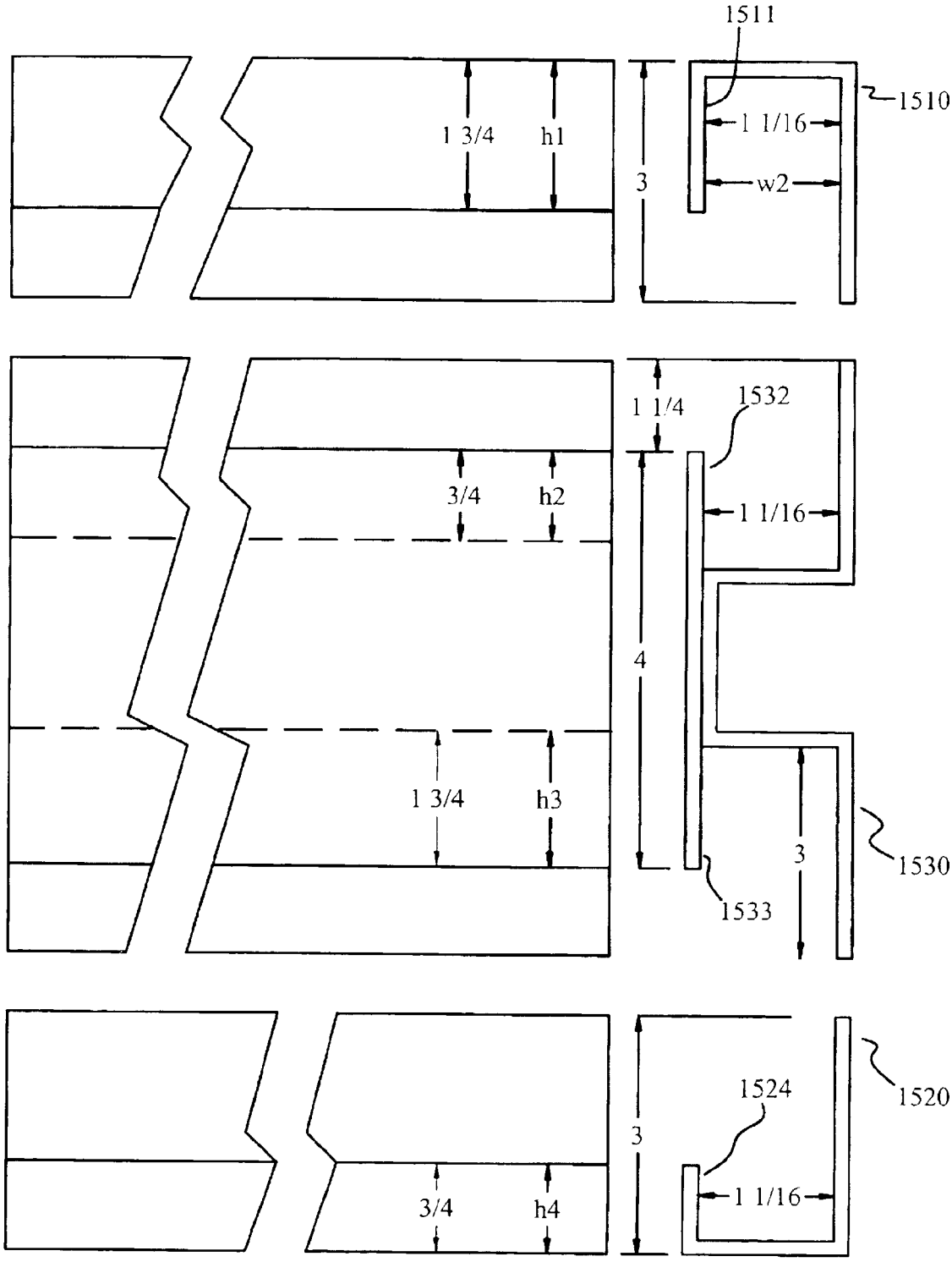
FIG. 6 shows a construction of upper, lower, and middle rails that may be used as retention mechanisms.

A side view of a ceiling rail 1510, floor rail 1520 and middle rail 1530 are shown in FIG. 6. Each are preferably formed by bending sheets of 16 gauge steel, and can be connected to a wall 50 of enclosure 100 by suitable means, such as with screws. Note that ceiling rail 1510, floor rail 1520 and middle rail 1530 exhibit an interior width w2 sufficiently wide to accommodate insertion of an acoustic panel 1000. Thus, ceiling rail 1510, floor rail 1520 and middle rail 1530 provide channels for the insertion and retention of upper and lower rows of panels 1000. Any wall or surface can be made to provide acoustic absorptivity using the methods and apparatus of the present invention disclosed herein by appropriately placement of retention channels.

Figure 7:
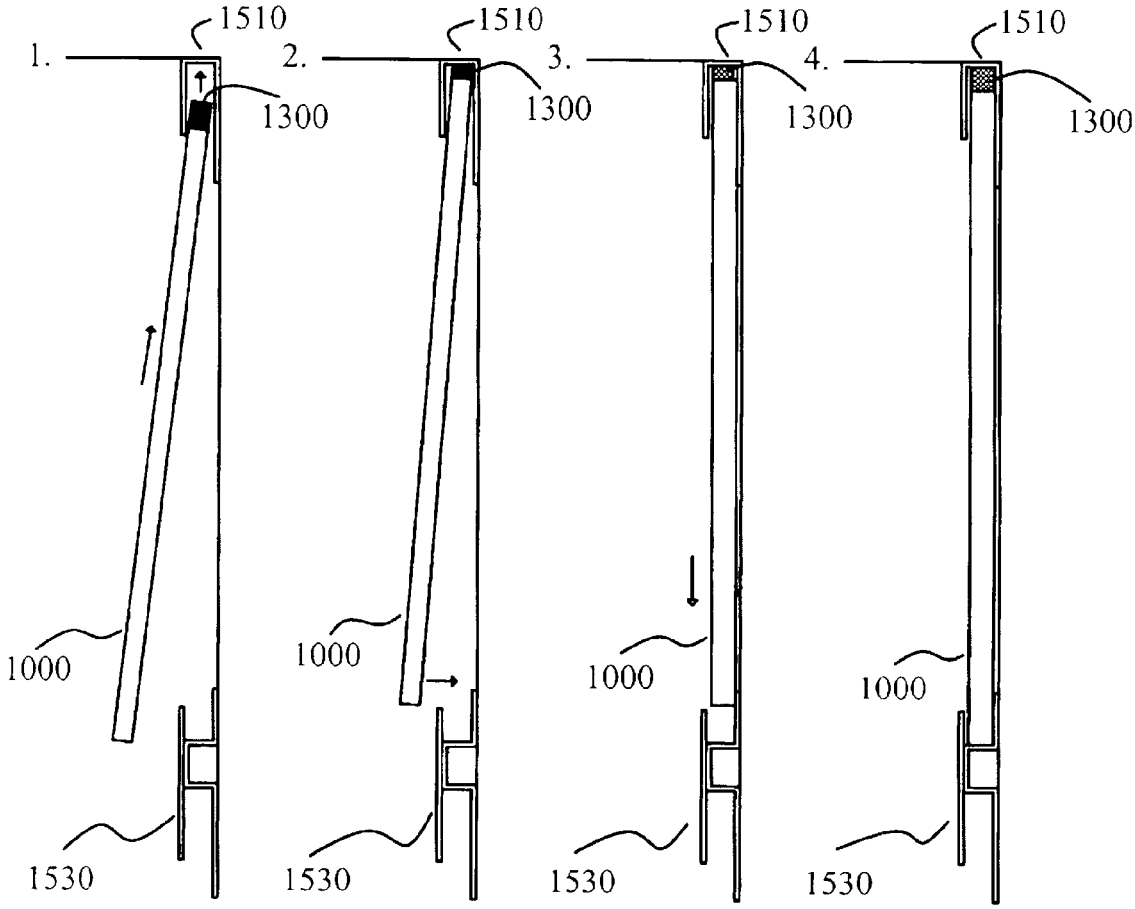
FIG. 7, shows how an absorbing panel may be installed.

FIG. 7 illustrates how upper row 1550 of panels 1000 are inserted. First, the upper end of panel 1000 is inserted into ceiling rail 1510, which is affixed to a wall 50. Second, the compressible foam spring 1300 is compressed until the lower end of panel 1000 clears middle rail 1530, which is also affixed to wall 50. Third, the panel is pushed in against wall 50. Fourth, panel 1000 is pushed downward into middle rail 1530, thereby locking it into a retained position. Installation is the same for a lower row 1500 of panels 1000. Thus, ceiling rail 1510 and middle rail 1530 form an upper rail and a lower rail, respectively, for insertion and retention of an upper row 1550 of panels 1000. Similarly, middle rail 1530 and floor rail 1520 form an upper rail and a lower rail, respectively, for insertion and retention of a lower row 1500 of panels 1000. Note that elastic mechanism 1300 aids in panel retention by exhibiting force in a direction substantially parallel to wall 50 to which the rails are attached. Preferably, elastic mechanism 1300 is employed at a top edge of panel 1000, although alternatively, elastic mechanism 1300 could instead be employed at the bottom edge of panel 1000, or could be employed at both the top and bottom edge of panel 1000.

Clearly, the upper and lower rails are spaced and dimensioned to enable insertion of the upper portion of a panel into the upper rail, followed by insertion of the lower portion of the panel into the lower rail so that the panel is retained into position by the upper and lower rails. Referring again to FIG. 6, to enable insertion and retention of an upper panel, the dimension h1 of the upper retaining edge 1511 of ceiling rail 1510 is greater than the dimension h2 of lower retaining edge 1532 of middle rail 1530. To enable insertion and retention of a lower panel the dimension h3 of upper retaining edge 1533 of middle rail 1530 is greater than the dimension h4 of lower retaining edge 1524 of floor rail 1520. Further, the spacing between ceiling rail 1510 and middle rail 1530 is greater than the height H1 of an upper panel but less than the sum, H1+h2, of the height of the upper panel and the dimension of the lower retaining edge 1532 of middle rail 1530. Similarly, the spacing between middle rail 1530 and floor rail 1520 is greater than the height H2 of a lower panel but less than the sum, H2+h4, of the height of the lower panel and the dimension of the lower retaining edge 1524 of floor rail 1520.

As noted above, in an alternative embodiment, elastic mechanism 1300 could be employed at a bottom edge of a panel 1000 to be received by a lower rail. In this case, to enable insertion and retention of an upper panel, the dimension h1 of the upper retaining edge 1511 of ceiling rail 1510 is less than the dimension h2 of lower retaining edge 1532 of middle rail 1530. To enable insertion and retention of a lower panel the dimension h3 of upper retaining edge 1533 of middle rail 1530 is less than the dimension h4 of lower retaining edge 1524 of floor rail 1520. Further, the spacing between ceiling rail 1510 and middle rail 1530 would then be greater than the height H1 of an upper panel but less than the sum, H1+h1, of the height of the upper panel and the dimension of the lower retaining edge 1532 of middle rail 1530. Similarly, the spacing between middle rail 1530 and floor rail 1520 would then be greater than the height H2 of a lower panel but less than the sum, H2+h3, of the height of the lower panel and the dimension of the lower retaining edge 1524 of floor rail 1520.

Figure 8:
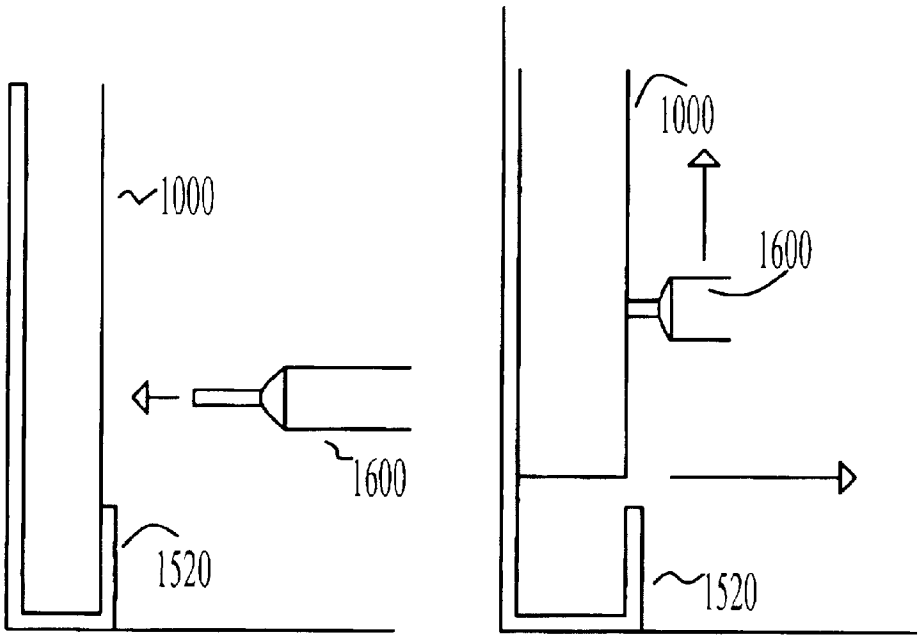
FIG. 8 shows insertion of a probe-like tool to assist in panel removal.

The process of panel removal is simply the reverse of panel installation. As shown in FIG. 8, any panel 1000 can be removed by inserting a probe-like tool 1600 into a perforation of panel 1000, lifting upward and outward. Thus, the present invention affords a quick and easy method for acoustic panel installation and removal. Further, any one or more panels can be removed, repaired and replaced without substantial deconstruction of the acoustic structure. Moreover, each panel can be removed or installed without the need for fasteners such as screw, rivets and the like.

Once a panel 1000 is removed it can be serviced by, for example, painting or straightening. Also, the acoustic absorbing material 1400 within panel 1000 can be replaced by the same material structure or a different material structure. Alternatively, the entire panel can simply be replaced.

Thus, the present invention provides a method for constructing an acoustic absorbing structure with removable and serviceable acoustic absorbing panels, comprising the steps of providing an upper retention mechanism for receiving an upper portion of a panel, providing a lower retention mechanism for receiving a lower portion of the panel, and spacing and dimensioning the upper and lower retention mechanisms to enable insertion of one end portion of a panel into a first one of the retention mechanisms, followed by insertion of an opposite end portion of the panel into the second one of the retention mechanisms so that the panel is retained into position by the upper and lower retention mechanisms. Preferably, a retention mechanism extends in dimension to be at least as wide as an acoustic panel, and preferably as wide as the total width of all of the panels used to provide an acoustic covering for a wall or surface to which the panels are applied. Alternatively, a retention mechanism may extend in dimension to be only partially as wide as an acoustic panel to be retained thereby. Also, multiple upper and lower retention mechanisms can be employed to retain one or more panels.

Figure 9:
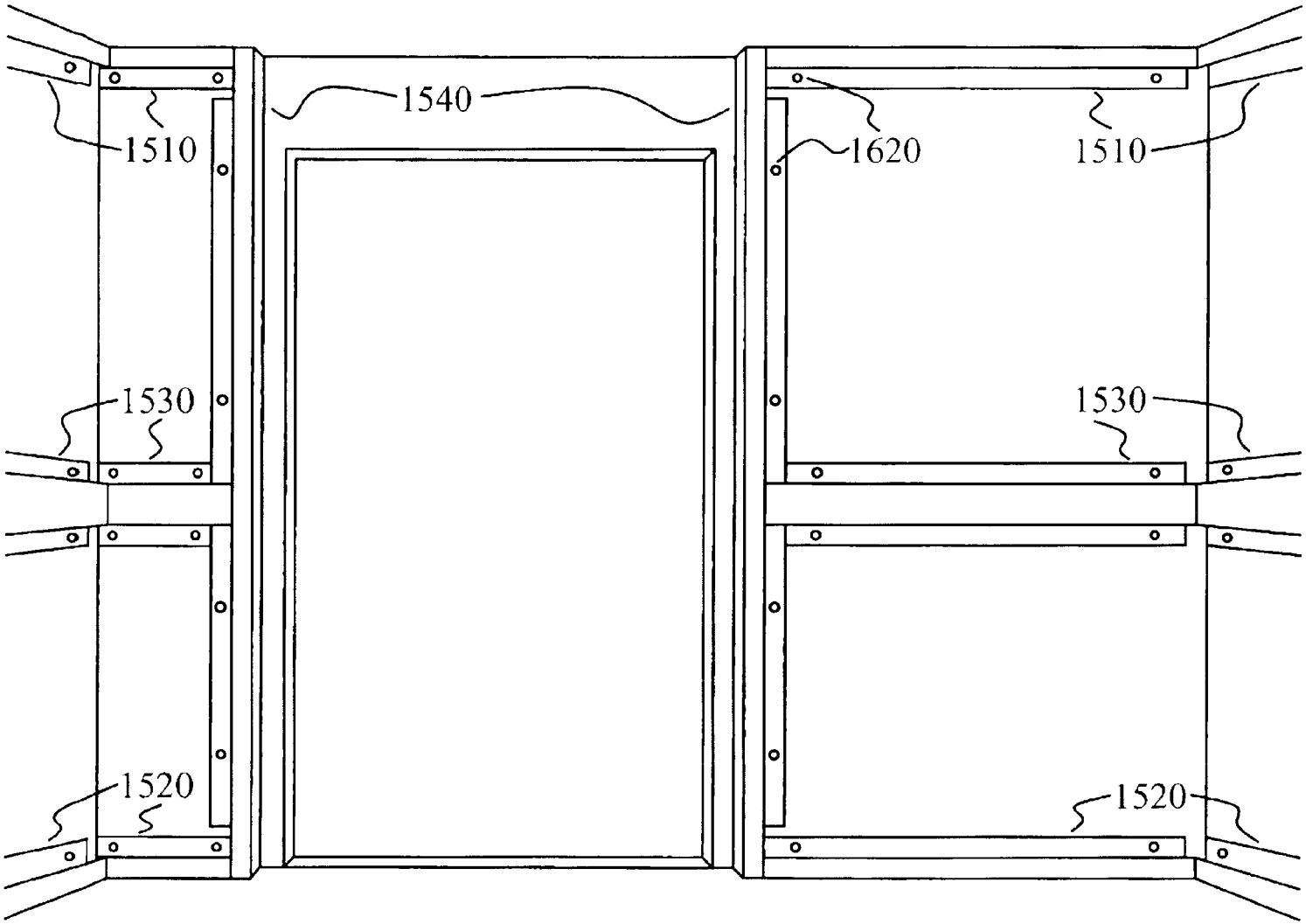
FIG. 9 shows affixation of upper, lower and middle retention rails and end rails in a room to be fitted with removable acoustic panels.

According to the methods of the present invention, any existing structure can be acoustically fitted by installation of upper and lower panel retention mechanisms, such as ceiling rails 1510, floor rails 1520 and middle rails 1530, followed by simple insertion of acoustic panels 1000. Installation of ceiling rails 1510, floor rails 1520, and middle rails 1530 in preparation for insertion of panels 1000 is shown in FIG. 9. End rails 1540, constructed similarly to the upper and lower rails described herein, are inserted where a side edge 1230 or 1240 of a panel 1000 would otherwise be exposed, as in the case, for example, where a door to the enclosure exists. The end rails form an additional channel for retaining a panel 1000. An elastic mechanism, similar to the elastic mechanism 1300 employed at an end of the panel received by an upper or lower rail, as described above, may also be employed at an edge of a panel to be inserted into an end rail. Further, an end rail may be provided on each side of an acoustic panel to retain the panel by its edges. As noted above, the channels for retention and removal of one or more panels 1000 can be affixed to a wall using screws 1620 or other securing mechanism.

Thus, the invention enables installation of an acoustic absorbing structure to a wall or room that is not originally designed to exhibit any particular acoustic performance, or where the acoustic performance is not adequate or should be altered. The invention also enables simple and quick installation and removal of any one or more acoustic absorbing panels for repair, maintenance or replacement, without the need for fastening or unfastening a panel to a structure.

Although the present invention and its advantages have been described in detail, it should be understood that various changes, substitutions and alterations can be made herein without departing from the spirit and scope of the invention as defined by the appended claims. The invention achieves multiple objectives and because the invention can be used in different applications for different purposes, not every embodiment falling within the scope of the attached claims will achieve every objective. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for constructing an acoustic absorbing structure with removable acoustic absorbing panels, comprising the steps of:

providing a first retention mechanism for receiving an end portion of a panel;

providing a second retention mechanism for receiving an opposite end portion of the panel; and spacing and dimensioning the first and second retention mechanisms to enable insertion of one end portion of a panel into a first one of the retention mechanisms, followed by insertion of an opposite end portion of the panel into the second one of the retention mechanisms so that the panel is retained into position by the first and second retention mechanisms; and wherein an elastic mechanism is provided at an end of a panel received by a retention mechanism for retention of said panel.

2. The method of claim 1, wherein the first and second retention mechanisms are securable to a pre-existing structure to alter the acoustic properties of the pre-existing structure.

3. The method of claim 1, wherein a retention mechanism extends in dimension to be at least as wide as an acoustic panel to be retained by the mechanism.

4. The method of claim 1, further comprising the step of inserting a panel into said retention mechanisms.

5. The method of claim 4, wherein a panel is inserted by first inserting an upper portion of the panel into the first retention mechanism, followed by inserting the lower portion of the panel into the second retention mechanism.

6. The method of claim 1, further comprising the step of removing a panel from said retention mechanisms.

7. The method of claim 6, wherein a panel is removed by first removing a lower portion of the panel from the second retention mechanism, followed by removing the upper portion of the panel from the first retention mechanism.

8. The method of claim 1, further comprising the step of providing an end channel for receiving an edge portion of a panel.

9. The method of claim 8, wherein an elastic mechanism is provided at an edge of a panel received by an end channel.

10. The method of claim 1, wherein absorbing material is removably retained in proximity to an interior surface of a panel.

11. An acoustic absorbing structure with removable acoustic absorbing panels, comprising:

an upper retention mechanism for receiving an upper portion of a panel; and a lower retention mechanism for receiving a lower portion of the panel; wherein the first and second retention mechanisms are spaced and dimensioned to enable insertion of one end portion of a panel into a first one of the retention mechanisms, followed by insertion of an opposite end portion of the panel into the second one of the retention mechanisms so that the panel is retained into position by the upper and lower retention mechanisms; and wherein an elastic mechanism is provided at an end of a panel received by a retention mechanism for retention of said panel.

12. The apparatus of claim 11, wherein the upper and lower retention mechanisms are secured to a pre-existing structure to alter the acoustic properties of the pre-existing structure.

13. The apparatus of claim 11, wherein a retention mechanism extends in dimension to be at least as wide as an acoustic panel to be retained by the mechanism.

14. The apparatus of claim 11, wherein absorbing material is removably retained in proximity to an interior surface of a panel.

15. A system for fastener-less removal and insertion of acoustic absorbing panels, comprising:

a first and second retention mechanism securable to a structure to enable an acoustic absorbing panel to be retained by the mechanisms fastener-lessly.

wherein an elastic mechanism is provided at an end of a panel received by a retention mechanism for retention of said panel.

16. The system of claim 15, wherein the first and second retention mechanisms are spaced and dimensioned to enable insertion of one end portion of a panel into a first one of the retention mechanisms, followed by insertion of an opposite end portion of the panel into the second one of the retention mechanisms so that the panel is retained into position by the first and second retention mechanisms.

17. The system of claim 15, wherein absorbing material is removably retained in proximity to an interior surface of a panel.

18. The system of claim 15, wherein a retention mechanism extends in dimension to be at least as wide as an acoustic panel to be retained by the mechanism.

19. The system of claim 15, further comprising the step of providing an end channel for receiving an edge portion of a panel.

* * * * *